US005495950A

United States Patent [19]

Jellum

[11] Patent Number: 5,495,950

[45] Date of Patent: Mar. 5, 1996

[54] ARTICLE SORTER

[76] Inventor: Roger D. Jellum, 29202-37th Pl. S., Auburn, Wash. 98001

[21] Appl. No.: 292,780

[22] Filed: Aug. 18, 1994

[51] Int. Cl.[6] ..... B07C 7/04; B65D 85/00

[52] U.S. Cl. ..... 209/703; 209/942; 206/526; 220/526

[58] Field of Search ..... 209/702, 703, 209/706, 707, 942; 206/526; 220/23.4, 526; 312/211; 33/199 R, 483

[56] References Cited

U.S. PATENT DOCUMENTS

| | | | |
|---|---|---|---|
| 3,747,756 | 7/1973 | Wheeler | 209/703 |
| 4,303,285 | 12/1981 | Wiegers | 312/211 |
| 4,494,804 | 1/1985 | O'Keeffe | 312/211 |
| 4,573,751 | 3/1986 | Swank | 312/211 |
| 4,615,571 | 10/1986 | Swank | 312/211 |
| 4,913,501 | 4/1990 | Swank | 312/211 |
| 5,163,578 | 11/1992 | Eitriem et al. | 220/526 |
| 5,181,619 | 1/1993 | Noble | 209/706 X |
| 5,344,024 | 9/1994 | Cohn | 209/702 X |

FOREIGN PATENT DOCUMENTS

| | | | |
|---|---|---|---|
| 235365 | 7/1960 | Australia | 209/703 |
| 973122 | 8/1975 | Canada | 209/702 |

*Primary Examiner*—William E. Terrell
*Assistant Examiner*—Tuan Nguyen
*Attorney, Agent, or Firm*—Joan H. Pauly

[57] ABSTRACT

A sorting device has a base with an upper horizontal support surface having an outer mounting edge to which a tray is hingedly connected. The tray has a bottom wall providing a sorting surface and sidewalls around the periphery of the bottom wall. The sidewalls have converging portions that converge toward a discharge end to define a discharge opening. The hinge is attached to the bottom of the tray at a location spaced inwardly from the discharge end to permit the tray to be pivoted between a sorting position, in which its bottom wall rests on the support surface, and a discharge position, in which the discharge end is tilted downwardly relative to the mounting edge to allow discharge of articles from the sorting surface, through the discharge opening, and into a container placed adjacent to the base. The base may have a box-like configuration and provide storage space for containers. In such case, the tray preferably covers the open top of the base. The base and tray may be provided with handles for carrying the device. Another base configuration is in the form of a C-clamp.

10 Claims, 2 Drawing Sheets

Fig. 1
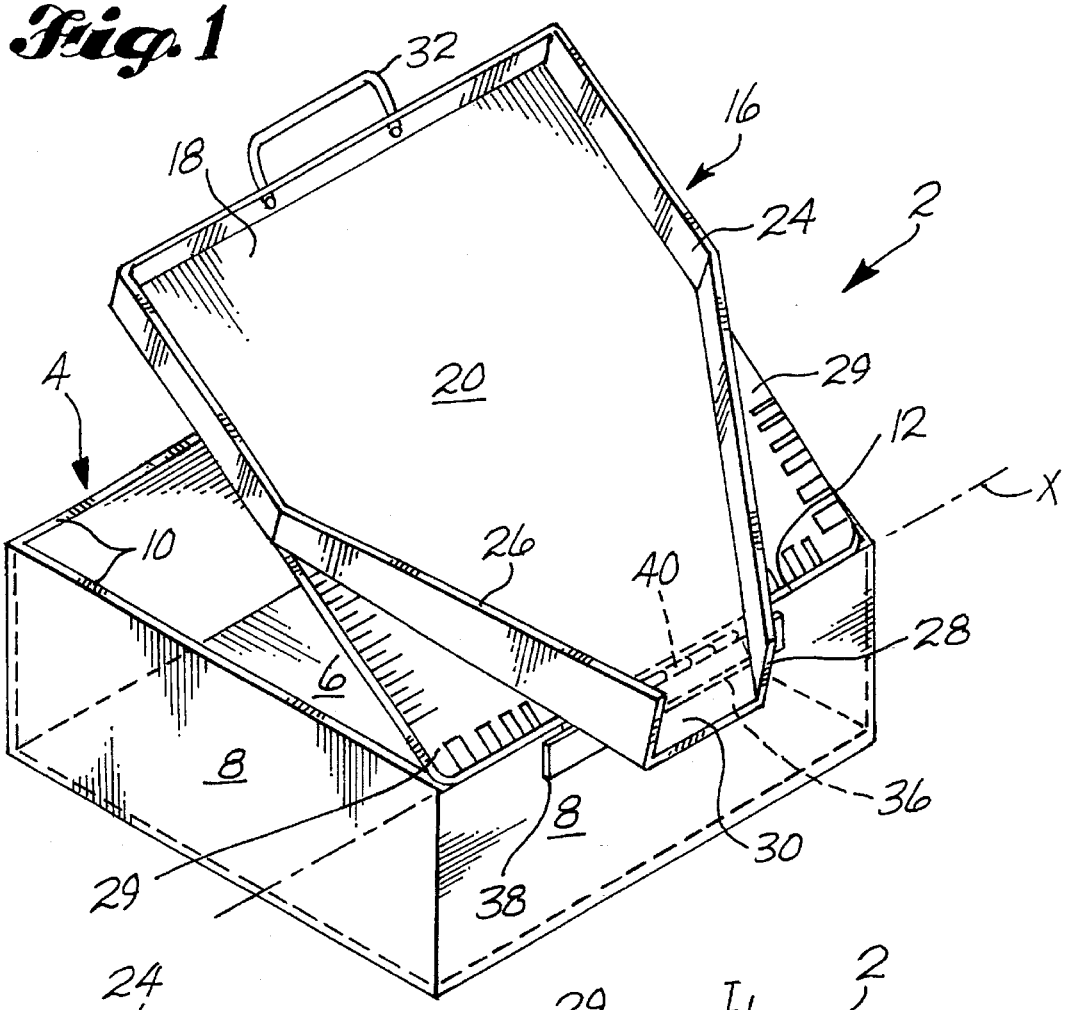
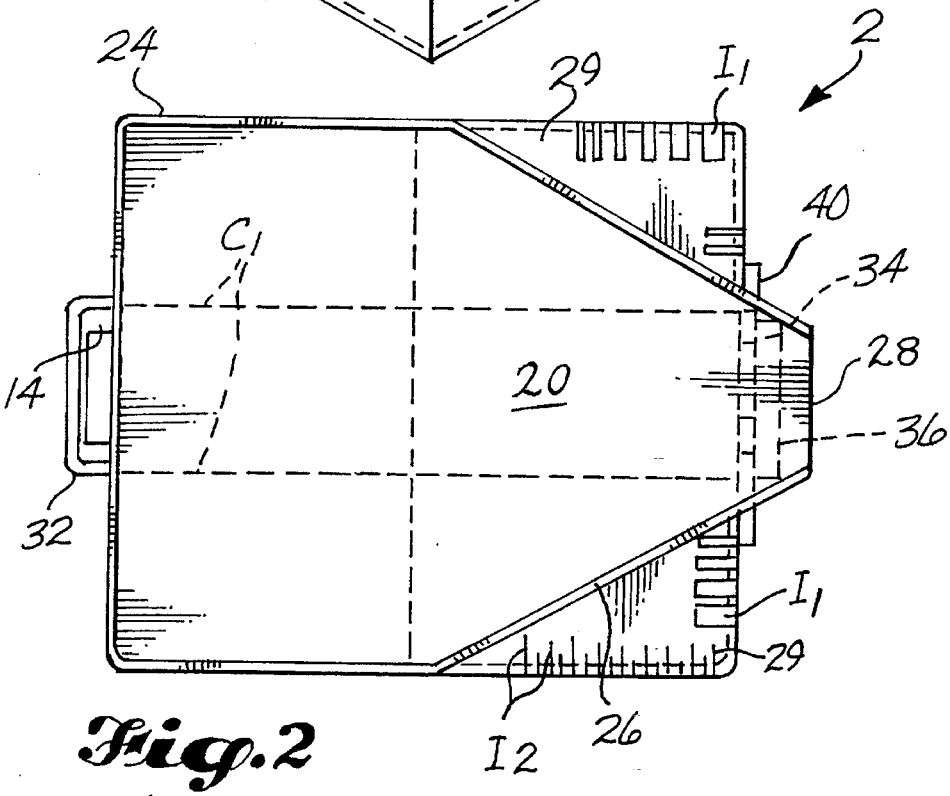
Fig. 2

ARTICLE SORTER

TECHNICAL FIELD

This invention relates to devices for sorting articles and, more particularly, to such a device having a sorting tray hingedly connected to a base with the hinge location being positioned inwardly from a tapered discharge end of the tray to permit the discharge end to be tilted downwardly relative to the hinge location to discharge articles from the tray into a container placed adjacent to the base.

BACKGROUND INFORMATION

U.S. Pat. No. 3,747,756, granted Jul. 24, 1973, to L. M. Wheeler, discloses a sorting and pouring tray having a depending lip at one end that forms a pouring spout. A box-like device having a top sorting tray hingedly connected to the box at one edge of the tray is disclosed in each of U.S. Pat. Nos. 4,494,804, granted Jan. 22, 1985, to L. O'Keeffe; and 4,573,751, granted Mar. 4, 1986, to R. P. Swank. In each of the devices, articles on the tray are dumped down into a container positioned in the box when the tray is tilted about the hinge. O'Keeffe discloses a chart which has indicia for determining the length of a bolt and holes for determining the diameter of a bolt. The chart is removably supported on an edge of the tray by a tongue and slot arrangement. In each of the two patents, the tray includes a handle to be grasped for tilting the tray. Also in each patent, depositing articles in a desired container requires positioning containers within the box-like structure so that the desired container is below an upper opening through which the articles on the tray fall when the tray is tilted. Storage and sorting devices having a box-like structure with an edge to which an edge of a sorting tray is hingedly connected are disclosed in U.S. Pat. Nos. 4,615,571, granted Oct. 7, 1986, and 4,913,501, granted Apr. 3, 1990, both to R. P. Swank. In each of these two devices, the tray or box has a specialized engagement portion for mounting a particular type of container preparatory to tilting the tray to dump articles into the container.

SUMMARY OF THE INVENTION

The subject of the invention is a device for sorting articles. According to an aspect of the invention, the device comprises a base, a tray, and a hinge. The base has an upper horizontal support surface with an outer mounting edge. The tray has a bottom wall with an upper sorting surface and an opposite lower surface, and sidewalls extending upwardly from peripheral portions of the bottom wall. The tray has a discharge end. The sidewalls have converging portions that converge toward the discharge end to define a discharge opening in the sidewalls at the discharge end. The hinge is attached to the mounting edge of the base and to the lower surface of the bottom wall of the tray to pivotably mount the tray on the base. The hinge is attached to the bottom wall at a location spaced inwardly from the discharge end to permit the tray to be pivoted between a sorting position and a discharge position. In the sorting position, the bottom wall rests on the support surface. In the discharge position, the discharge end is tilted downwardly relative to the mounting edge to allow discharge of articles from the sorting surface, through the discharge opening, into a container placed adjacent to the base.

There are presently two preferred embodiments of the invention. In a first preferred embodiment, the base includes a bottom and sidewalls that define a space for storing a plurality of containers. In the other embodiment, the base comprises a C-clamp having upper and lower horizontal legs connected by a vertical leg. The support surface is formed by the upper leg. In each of the two embodiments, there is preferably a handle attached to an end portion of the tray opposite the discharge end for tilting the tray into the discharge position.

There are a number of preferred features that may be included in the first embodiment. Preferably, the upper portions of the sidewalls of the base form the support surface for the tray. The base has an upper opening that provides access to the storage space, and the tray covers the upper opening when the tray is in its sorting position. An additional preferred feature of this arrangement in which the tray forms the top of the device is a pair of handles attached to the tray and the base, respectively, opposite the discharge end. The handles are positioned to be grasped simultaneously to carry the device while maintaining the upper opening covered by the tray, and to permit the handle that is attached to the tray to be separately grasped to tilt the tray relative to the base. The shape of the box-like base may be varied. Preferably, the base and the upper opening have a substantially rectangular plan configuration. When such a configuration is used, the tray preferably has a pair of substantially triangular wings coplanar with the bottom wall of the tray and positioned adjacent to the converging portions of the sidewalls of the tray. The wings and the bottom wall together cover the upper opening when the tray is in its sorting position. The wings may be provided with indicia for measuring parameters of articles.

The device of the invention has the advantages of simplicity of construction and a high level of versatility with regard to the types of containers into which articles from the tray may be discharged without spilling the articles. Since the hinge location in the device is spaced inwardly from the discharge end of the tray, containers of various sizes and shapes may be positioned under the discharge end to discharge articles into the containers. The containers may be positioned either by holding them adjacent to the base or resting them on a support surface adjacent to the base. If desired, the discharge end may actually be pivoted downwardly into the open upper end of a container as long as the upper end is sufficiently wide relative to the discharge end. In the case of the box-like base, there is no need to rearrange containers stored in the base in order to position a particular container for receiving articles from the tray. In addition, with respect to either embodiment, there is no need for a container having a specific configuration since there is no need for the container to properly fit a specialized engagement portion of the device.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 1 is a pictorial view of a first preferred embodiment of the invention showing the tray in a tilted discharge position.

FIG. 2 is a top plan view of the device shown in FIG. 1 showing the tray in a horizontal sorting position and schematically illustrating six rectangular containers stored in the base.

BEST MODES FOR CARRYING OUT THE INVENTION

Figure 6:
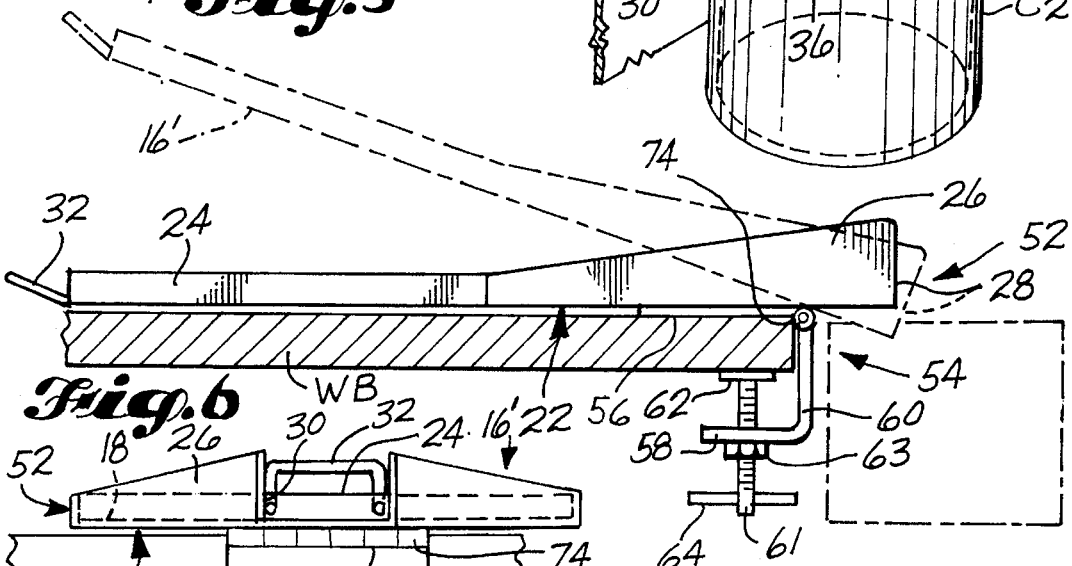
FIG. 6 is a side elevational view of a second preferred embodiment of the invention installed on a work bench, with the sorting position shown in solid lines and the discharge position shown in broken lines.
Figure 7:
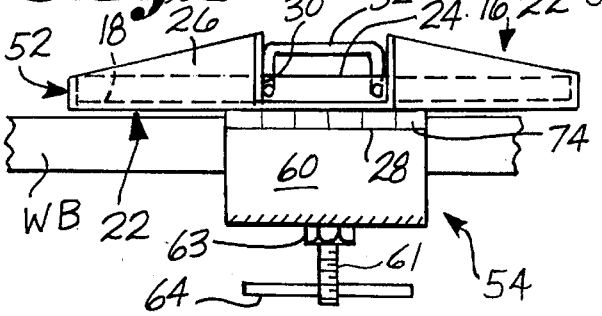
FIG. 7 is a front elevational view of the device shown in FIG. 6 with the tray in its sorting position.

The drawings show two embodiments of the device 2, 52 that are constructed according to the invention and that constitute the best modes for carrying out the invention currently known to the applicant. The base of the device shown in FIGS. 1–5 has a box-like configuration. The base of the device shown in FIGS. 6 and 7 is in the form of a C-clamp. The base could also be provided in other forms. The drawings illustrate two shapes of containers into which articles may be discharged from the tray portion of the device. The containers are rectangular containers $C_1$ and a cylindrical container $C_2$. These containers are shown for the purposes of illustration. The device of the invention may also be used for discharging articles into containers having various other configurations.

Figure 3:
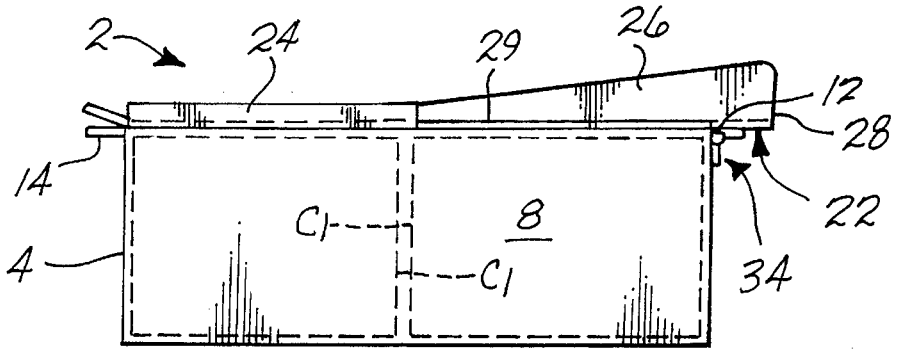
FIG. 3 is a side elevational view of the device and containers shown in FIG. 2.
Figure 5:
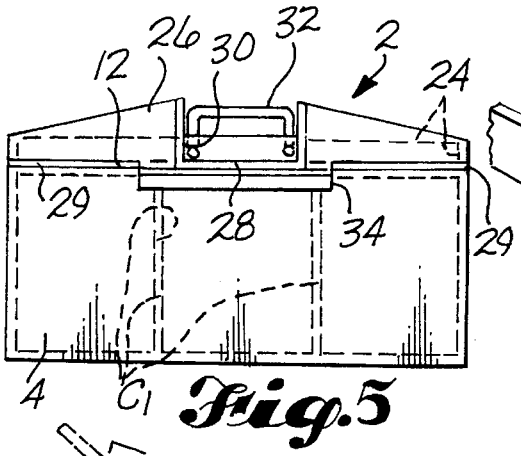
FIG. 5 is a front elevational view of the device and containers shown in FIGS. 2 and 3.

Referring to FIGS. 1–3 and 5, the device 2 has a rectangular box-like base 4 with a solid bottom 6, four sidewalls 8, and an open top. The bottom 6 and sidewalls 8 together define a space for storing a plurality of containers. The upper ends of the sidewalls 8 form a horizontal support surface 10. The front upper edge of the front sidewall 8 is a mounting edge 12 to which the tray portion of the device is mounted. The base 4 preferably has a handle 14 opposite its mounting edge 12, as shown in FIGS. 2 and 3. FIGS. 2, 3, and 5 illustrate six rectangular containers $C_1$ stored in the space provided by the base 4.

Still referring to FIGS. 1–3 and 5, the device 2 also includes a sorting tray 16. The tray 16 has a bottom wall 18 with an upper sorting surface 20 and an opposite lower surface 22 (FIG. 3). Sidewalls 24 extend upwardly from the periphery of the bottom wall 18. The sidewalls extend along the two opposite sides of the bottom wall 18 and along the rear end thereof. The front portions 26 of the lateral sidewalls converge toward each other and toward a discharge end 28 of the tray 16. At the discharge end 28, there is a gap between the two converging sidewall portions 26 that forms a discharge opening 30.

Preferably, the tray 16 has a handle 32 extending rearwardly and slightly upwardly from the rear sidewall portion opposite the discharge end 28. The handle 32 is positioned above the handle 14 on the base 4 so that the two handles 14, 32 can be simultaneously grasped. When the handles have been grasped, the device 2 may be lifted and carried.

The tray 16 is pivotably mounted on the base 4 by means of a hinge 34. The hinge 34 is attached to the mounting edge 12 of the base 4 and to the lower surface 22 of the bottom wall 18 of the tray 16. The hinge 34 is attached to the bottom wall 18 at a location spaced inwardly (rearwardly) from the discharge end 28 of the tray 16, as shown in FIGS. 1–4. This permits the tray 16 to be pivoted between its horizontal sorting position, shown in FIGS. 2, 3, and 5, and a tilted discharge position, shown in FIGS. 1 and 4. In the discharge position, the discharge end 28 of the tray 16 is tilted downwardly relative to the mounting edge 12 to allow discharge of articles from the sorting surface 20, through the discharge opening 30, into a container placed adjacent to the base 4.

Figure 4:
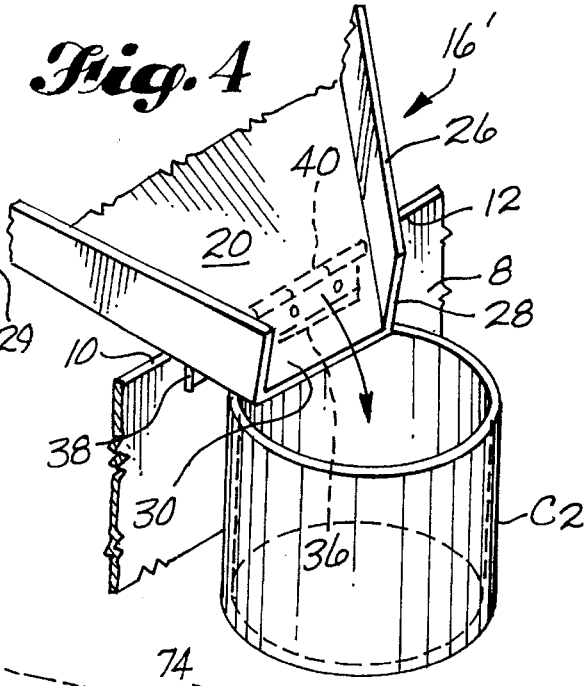
FIG. 4 is a fragmentary pictorial view showing a modified version of the tray shown in FIGS. 1–3 tilted to discharge articles into a container.

FIG. 4 illustrates the discharge position of the discharge end 28 of the tray and the placement of a cylindrical container $C_2$ adjacent to the front sidewall 8 of the base 4 for receiving articles from the tray. The tray 16' shown in FIG. 4 is the same as the tray shown in FIGS. 1–3 and 5 except that the wings 29 shown in FIGS. 1–3 and 5 and described below have been omitted to facilitate illustration of the discharge position. As can be seen in FIG. 4, the tilting of the tray 16' allows the discharge end 28 to be positioned above the open top of the container $C_2$ and further permits the discharge end 28 to be lowered down into the container $C_2$ a short distance to help ensure that articles are not spilled.

When the base of the device of the invention has a box-like configuration, it preferably has a substantially rectangular plan configuration and an open top. The device 2 preferably has a pair of substantially triangular wings 29. The wings 29 are preferably part of the tray 16, as shown in FIGS. 1–3 and 5, but they could also be part of the base 4. As shown, the wings 29 are coplanar with and form an extension of the bottom wall 18 of the tray 16 and are positioned adjacent to the converging portions 26 of the tray sidewalls 24. The wings 29 and bottom wall 18 together form a substantially rectangular flat bottom surface that is dimensioned to cover the open rectangular top of the box-like base 4 when the tray 16 is in its lowered horizontal sorting position shown in FIGS. 2, 3, and 5. The peripheral edge portions of the bottom surface of the bottom wall 18 and wings 29 rest on the support surface 10 provided by the base sidewalls 8. In this arrangement, the storage space defined by the base 4 is completely enclosed. Therefore, when the two handles 14, 32 are grasped and the device 2 is lifted for carrying, the open top of the base 4 remains covered and the device 2 can be carried without disturbing containers $C_1$ stored in the base 4 or articles located in the containers $C_1$.

As shown in FIGS. 1–5, the hinge 34 is a separate member that has a first leaf 36 secured to the bottom wall 18 of the tray 16 and a second leaf 38 secured to the front face of the front sidewall 8 of the base 4 to position the hinge knuckles 40 at the mounting edge 12. The first leaf 36 is narrower than the second leaf 38 since it engages the bottom wall 18 of the tray 16 forwardly of the mounting edge 12 and the tray wings 29. This arrangement ensures that the bottom surface of the bottom wall 18 and wings 29 is flush with the support surface 10 when the tray 16 is in its sorting position. If the hinge leaf 36 were oriented rearwardly, it could be slightly longer, i.e. the same length as the other leaf 38. Preferably, a recess in the sidewalls 8 of the base 4 would be provided for receiving the leaf 36 to maintain the flush engagement between the bottom of the tray 16 and the mounting surface 10. Alternatively, and in most circumstances preferably, the entire device can be made from molded plastic with the hinge 34 being integrally molded with the base 4 and tray 16. Whether the hinge is a separate member of is integrally molded, it may be provided as a single hinge or multi-part hinge. For example, it may include two spaced-apart portions that engage the bottom wall portions provided by the wings 29.

FIGS. 1 and 2 illustrate a preferred optional feature of the invention. This feature is the provision of indicia $I_1$, $I_2$ on the upper surface of the wings 29. As shown, the indicia include rectangular elements $I_1$ of varying sizes for measuring the diameters of articles, such as bolts. They also include ruler lines $I_2$ for measuring lengths. Other forms of indicia could also be provided. For example, a series of small holes could be provided instead of, or in addition to, the indicia $I_1$ for measuring diameters.

Referring to FIGS. 6 and 7, the second embodiment of the device 52 has a base 54 that is in the form of a C-clamp. The base 54 has an upper horizontal leg 56 and a lower horizontal leg 58 joined by a vertical leg 60. The upper surface of the upper leg 56 forms the support surface for the tray. A bolt 61 extends through the lower horizontal leg 58 and has an end member 62 that frictionally engages a support member WB when the bolt 61 is tightened to secure the device 52 to the support member WB in a known manner. Preferably, the bolt 61 is provided with a nut 63 and a handle 64. The handle 64 is in the form of a rod that extends through the shaft of the bolt 61 and that is easily grasped by an operator in order to tighten the clamp on a support member WB. The device 52 may be secured to various types of support members. For example, it may be conveniently secured to a board-like support surface of a work bench WB.

The tray portion of the device 52 shown in FIGS. 6 and 7 is the same as the tray 16' shown in FIG. 4, which is essentially identical to the tray 16 shown in FIGS. 1–3 and 5 except for the omission of the wings 29. The winged tray 16 shown in FIGS. 1–3 and 5 could also be used with the C-clamp base 54. The illustrated device 52 includes a hinge 74 provided at the juncture between the upper horizontal leg 56 and the vertical leg 60 of the base 54. The legs 56, 60 serve as the leaves of the hinge 74. As in the embodiment 2 discussed above, the hinge 74 is positioned at a rearwardly spaced location from the discharge end 28 of the tray 16'. This facilitates discharge of articles into a container $C_2$ from the tray 16', as illustrated in broken lines in FIG. 6.

The device of the invention may be used for sorting various types of articles. A typical use is for sorting a mixture of types and sizes of nuts and bolts. Such a mixture of articles is dumped onto the tray 16, 16' when the tray is in its lower sorting position shown in FIGS. 2, 3, and 5–7. When the articles are on the sorting surface 20 they may be easily sorted to locate a particular desired article. Then, the remainder of the articles are discharged into a container $C_1$, $C_2$ simply by tilting the tray 16, 16' about the hinge axis X (FIG. 1), as illustrated in FIGS. 1, 4, and 6. In the case of the embodiment of FIGS. 1–5, the slight upward angling of the tray handle 32 allows the handle 32 to be easily grasped separately from the base handle 14 to tilt the tray 16, 16' relative to the base 4. The container into which the articles are discharged may be one of those stored in the base 4 of the device 2 or some other container. In the case of the embodiment of FIGS. 6 and 7, the container may be any desired container within a broad size range.

As used herein, the terms "horizontal", "upper", "lower", and the like are used for the purposes of illustration and refer to the use orientation shown in FIGS. 2, 3, 5, and 7 and in solid lines in FIG. 6. The use of the terms is for the purpose of facilitating illustration and is in no way intended to limit the scope of the invention or to negate the tilted orientation shown in FIGS. 1 and 4 and in broken lines in FIG. 6.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed:

1. A device for sorting articles comprising:

a base having an upper horizontal support surface with an outer mounting edge;

a tray having a bottom wall with an upper sorting surface and an opposite lower surface, and sidewalls extending upwardly from peripheral portions of said bottom wall; said tray having a discharge end, and said sidewalls having converging portions converging toward said discharge end to define a discharge opening in said sidewalls at said end; and said tray having a reduced width end portion terminating in said discharge end; and a hinge attached to said mounting edge of said base and to said lower surface of said bottom wall of said tray to pivotably mount said tray on said base, said hinge being attached to said bottom wall at a location spaced inwardly from said discharge end and said reduced width end portion to permit said tray to be pivoted between a sorting position, in which said bottom wall rests on said support surface, and a discharge position, in which said discharge end is tilted downwardly relative to said mounting edge to allow discharge of articles from said sorting surface, through said opening, into a container placed adjacent to said base, and to permit said reduced width end portion to be tilted downwardly into a container placed adjacent to said base and having a top opening wider than said discharge end.

2. The device of claim 1, comprising a handle attached to an end portion of said tray opposite said discharge end for tilting said tray into said discharge position.

3. The device of claim 1, in which said base includes a bottom and sidewalls that define a space for storing a plurality of containers.

4. The device of claim 3, in which upper portions of said sidewalls of said base form said support surface, said base has an upper opening that provides access to said space, and said tray covers said upper opening when said tray is in its sorting position.

5. The device of claim 4, comprising a pair of handles attached to said tray and said base, respectively, opposite said discharge end; said handles being positioned to be grasped simultaneously to carry said device while maintaining said upper opening covered by said tray, and to permit said handle that is attached to said tray to be separately grasped to tilt said tray relative to said base.

6. The device of claim 1, in which said base comprises a C-clamp having upper and lower horizontal legs connected by a vertical leg, and said support surface is formed by said upper leg.

7. A device for sorting articles comprising:

a base having an upper horizontal support surface with an outer mounting edge;

a tray having a bottom wall with an upper sorting surface and an opposite lower surface, and sidewalls extending upwardly from peripheral portions of said bottom wall; said tray having a discharge end, and said sidewalls having converging portions converging toward said discharge end to define a discharge opening in said sidewalls at said end; and a hinge attached to said mounting edge of said base and to said lower surface of said bottom wall of said tray to pivotably mount said tray on said base, said hinge being attached to said bottom wall at a location spaced inwardly from said discharge end to permit said tray to be pivoted between a sorting position, in which said bottom wall rests on said support surface, and a discharge position, in which said discharge end is tilted downwardly relative to said mounting edge to allow discharge of articles from said sorting surface, through said opening, into a container placed adjacent to said base;

in which said base includes a bottom and sidewalls that define a space for storing a plurality of containers;

in which upper portions of said sidewalls of said base form said support surface, said base has an upper opening that provides access to said space, and said tray covers said upper opening when said tray is in its sorting position; and in which said base and said upper opening have a substantially rectangular plan configuration, and said tray has a pair of substantially triangular wings coplanar with said bottom wall and positioned adjacent to said converging portions of said sidewalls of said tray, said wings and said bottom wall together covering said upper opening when said tray is in its sorting position.

8. The device of claim 7, in which said wings have indicia for measuring parameters of articles.

9. The device of claim 8, comprising a pair of handles attached to said tray and said base, respectively, opposite said discharge end; said handles being positioned to be grasped simultaneously to carry said device while maintaining said upper opening covered by said tray, and to permit said handle that is attached to said tray to be separately grasped to tilt said tray relative to said base.

10. The device of claim 7, comprising a pair of handles attached to said tray and said base, respectively, opposite said discharge end; said handles being positioned to be grasped simultaneously to carry said device while maintaining said upper opening covered by said tray, and to permit said handle that is attached to said tray to be separately grasped to tilt said tray relative to said base.

* * * * *